US010944146B2

(12) United States Patent
Yoshimoto et al.

(10) Patent No.: US 10,944,146 B2
(45) Date of Patent: Mar. 9, 2021

(54) DIELECTRIC WAVEGUIDE HAVING A DIELECTRIC WAVEGUIDE BODY AND A DIELECTRIC WAVEGUIDE END WITH SPECIFIED DENSITIES AND METHOD OF PRODUCING

(71) Applicants: DAIKIN INDUSTRIES, LTD., Osaka (JP); NATIONAL INSTITUTE OF ADVANCED INDUSTRIAL SCIENCE AND TECHNOLOGY, Tokyo (JP)

(72) Inventors: Hiroyuki Yoshimoto, Osaka (JP); Dai Fukami, Osaka (JP); Taku Yamanaka, Osaka (JP); Masahiro Horibe, Tsukuba (JP); Yuto Kato, Tsukuba (JP); Ryo Sakamaki, Tsukuba (JP)

(73) Assignees: DAIKIN INDUSTRIES, LTD., Osaka (JP); NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 0 days.

(21) Appl. No.: 16/338,229

(22) PCT Filed: Sep. 29, 2017

(86) PCT No.: PCT/JP2017/035618
§ 371 (c)(1),
(2) Date: Mar. 29, 2019

(87) PCT Pub. No.: WO2018/062526
PCT Pub. Date: Apr. 5, 2018

(65) Prior Publication Data

US 2020/0036074 A1 Jan. 30, 2020

(30) Foreign Application Priority Data

Sep. 30, 2016 (JP) ..... 2016-194728

(51) Int. Cl.
*H01P 3/16* (2006.01)
*H01P 11/00* (2006.01)
*H01P 5/08* (2006.01)

(52) U.S. Cl.
CPC ..... *H01P 3/16* (2013.01); *H01P 5/087* (2013.01); *H01P 11/006* (2013.01)

(58) Field of Classification Search
CPC ..... H01P 3/16; H01P 5/087; H01P 11/006
(Continued)

(56) References Cited

U.S. PATENT DOCUMENTS 2,829,351 A * 4/1958 Fox ..... H01P 3/16 333/239
4,463,329 A 7/1984 Suzuki
(Continued)

FOREIGN PATENT DOCUMENTS

CN 105846070 A 8/2016
EP 0 699 915 A2 3/1996
(Continued)

OTHER PUBLICATIONS

Communication dated May 13, 2020, from the European Patent Office in application No. 17856473.8.
(Continued)

*Primary Examiner* — Benny T Lee
(74) *Attorney, Agent, or Firm* — Sughrue Mion, PLLC

(57) ABSTRACT

The invention provides a dielectric waveguide for transmitting millimeter waves or sub-millimeter waves. The dielectric waveguide is easily processed and connected even when having a small diameter, and can provide a connection structure exhibiting low transmission and return losses of high frequency signals. The dielectric waveguide includes a dielectric waveguide body and a dielectric waveguide end having a lower permittivity than the dielectric waveguide
(Continued)

body. The dielectric waveguide body and the dielectric waveguide end are seamlessly and monolithically formed from the same material.

11 Claims, 3 Drawing Sheets

(58) Field of Classification Search
USPC ..... 333/239, 248
See application file for complete search history.

(56) References Cited

U.S. PATENT DOCUMENTS

| | | | | |
|---|---|---|---|---|
| 4,825,221 | A * | 4/1989 | Suzuki et al. | H01P 3/16 333/239 |
| 2018/0040936 | A1* | 2/2018 | Yoshimoto et al. | C08J 5/18 |

FOREIGN PATENT DOCUMENTS

| | | | |
|---|---|---|---|
| GB | 2 185 861 | A | 7/1987 |
| JP | 59-85 | B2 | 1/1984 |
| JP | 10-123072 | A | 5/1998 |
| JP | 2003-209412 | A | 7/2003 |
| JP | 2012-222438 | A | 11/2012 |

OTHER PUBLICATIONS

Shuichi Shindo, et al., "100 GHz-tai dojiku-gata yudentai senro (100 GHz band coaxial dielectric waveguide)", IECE Technical Report, 1975, pp. 75-80, vol. 75, No. 189.

International Preliminary Report on Patentability with a Translation of Written Opinion in International Application No. PCT/JP2017/035618, dated Apr. 2, 2019.

International Search Report for PCT/JP2017/035618 dated Nov. 21, 2017 [PCT/ISA/210].

* cited by examiner

DIELECTRIC WAVEGUIDE HAVING A DIELECTRIC WAVEGUIDE BODY AND A DIELECTRIC WAVEGUIDE END WITH SPECIFIED DENSITIES AND METHOD OF PRODUCING

CROSS REFERENCE TO RELATED APPLICATIONS

This application is a National Stage of International Application No. PCT/JP2017/035618, filed on Sep. 29, 2017, which claims priority from Japanese Patent Application No. 2016-194728, filed on Sep. 30, 2016.

TECHNICAL FIELD

The invention relates to dielectric waveguides, connection structures, and methods for producing a dielectric waveguide.

BACKGROUND ART

Dielectric waveguides, waveguides, coaxial cables, and similar devices are used to transmit high frequency signals such as microwaves and millimeter waves. In particular, dielectric waveguides and waveguides are used as transmission lines for high frequency band electromagnetic waves such as millimeter waves. A common dielectric waveguide is composed of an inner layer and an outer layer and the common dielectric waveguide utilizes the difference in permittivity between the layers to transmit electromagnetic waves by side reflection. The outer layer may be the air. Still, in order to stabilize the permittivity and to achieve easy handling, the outer layer is usually a soft structure made of, for example, resin foam having low loss tangent tan δ and low permittivity. In practical implementation, transmission lines of different kinds are often coupled with each other. A dielectric waveguide may be coupled with a waveguide or a coaxial cable, or coaxial cables of different shapes may be coupled with each other. In order to reduce the return loss at a connection point of these different transmission lines, the impedances or modes of the transmission lines are to be matched to each other. Such matching of impedances or modes and conversion thereof for the matching are achieved using a special transformer or using a special structure. A rapid change in impedance may cause reflection of high frequency signals, resulting in loss of transmission efficiency.

Patent Literature 1 discloses a resonator with a dielectric waveguide. This resonator has a structure in which one or two dielectric waveguides are inserted in one or two holes made in a reflector of a Fabry-Perot resonator, wherein a tip of the dielectric waveguide inserted to stick to the resonator through the hole of the reflector is tapered with a conical shape, for example.

Patent Literature 2 discloses a coaxial waveguide transformer for connecting a circular coaxial line and a rectangular coaxial line. The coaxial waveguide transformer includes a ridge waveguide whose inner and outer conductors are monolithic, and the inner conductor is changed in a stepwise or tapering manner in the longitudinal direction.

Patent Literature 3 discloses a nonradiative dielectric line including dielectric lines between conductor plates. The dielectric lines include at least a dielectric line (i.e., line 1) made of a material of a prescribed dielectric constant and a dielectric line (i.e., line 2) made of a material of a dielectric constant lower than the material Non-Patent Literature 1 discloses preparation of a polyethylene waveguide that has a circular cross section and is provided with a conical horn at each end, and measurement of the $HE_{11}$ transmission loss thereof.

CITATION LIST

Patent Literature

Patent Literature 1: JP H10-123072 A (published May 15, 1998)

Patent Literature 2: JP 2012-222438 A (published Nov. 12, 2012)

Patent Literature 3: JP 2003-209412 A (published Jul. 25, 2003)

Non-Patent Literature

Non-Patent Literature 1: Shuichi SHINDO and Isao OTOMO, "100 GHz-tai dojiku-gata yudentai senro (100 GHz band coaxial dielectric waveguide)", IECE Technical Report, 1975, Vol. 75, No. 189, p. 75-80

SUMMARY OF THE INVENTION

Technical Problem

The methods of using a special shape as disclosed in Patent Literature documents 1 and 2 have difficulty in processing a narrow dielectric waveguide into such a special shape, and thus cannot be used as methods for transmitting millimeter waves or sub-millimeter waves. Further, improved transmission efficiency is awaited. In the method of inserting a tapered dielectric waveguide and fixing the tapered dielectric waveguide to a converting portion as disclosed in Patent Literature 1, the dielectric waveguide portion is bent and a stress is applied, so that the tip of the tapered structure is displaced. This causes a change in properties of reflecting high frequency signals at the converting portion, resulting in unstable performance.

Patent Literature 3 also discloses the following. In the method disclosed therein with the use of the dielectric line (line 1) made of a material of a high dielectric constant, electromagnetic waves are not directly input to/output from the dielectric line (line 1) made of a material of a high dielectric constant but are input/output via the dielectric line (line 2) made of a material of a low dielectric constant. This can reduce reflection of electromagnetic waves toward the line 1 and enables easy input/output of electromagnetic waves. This method involves bonding of two dielectric lines of different materials, and forming an interface having low reflection is difficult unfortunately.

In the method disclosed in Non-Patent Literature 1, horn-shaped jigs are attached to a dielectric waveguide.

The invention therefore aims to provide a dielectric waveguide which is easily processed and connected even when having a small diameter and can provide a connection structure exhibiting low transmission and return losses of high frequency signals.

The invention also aims to provide a connection structure for connecting a dielectric waveguide and a waveguide which enables easy processing and connection even when having small diameters and shows low transmission and return losses of high frequency signals.

The invention also aims to provide a method for producing a dielectric waveguide enabling easy production of a dielectric waveguide that includes a dielectric waveguide end having a lower permittivity or density than a dielectric waveguide body, that is easily processed and connected even when having a small diameter, and that can provide a connection structure exhibiting low transmission and return losses of high frequency signals.

Solution to the Problem

A first dielectric waveguide provided in the invention includes a dielectric waveguide body and a dielectric waveguide end having a lower permittivity than the dielectric waveguide body, and the dielectric waveguide body and the dielectric waveguide end are seamlessly and monolithically formed from a same material.

A second dielectric waveguide provided in the invention includes a dielectric waveguide body and a dielectric waveguide end having a lower density than the dielectric waveguide body, and the dielectric waveguide body and the dielectric waveguide end are seamlessly and monolithically formed from a same material.

In each of the first and second dielectric waveguides of the invention, the dielectric waveguide is preferably obtainable by stretching an end of a resin line in a longitudinal direction.

In each of the first and second dielectric waveguides of the invention, preferably, the dielectric waveguide body has a permittivity of 2.05 or higher and 2.30 or lower and the dielectric waveguide end has a permittivity of 2.20 or lower.

In each of the first and second dielectric waveguides of the invention, the dielectric waveguide body preferably has a hardness of 95 or higher.

In each of the first and second dielectric waveguides of the invention, the dielectric waveguide body preferably has a loss tangent at 2.45 GHz of $1.20\times10^{-4}$ or lower.

In each of the first and second dielectric waveguides of the invention, preferably, the dielectric waveguide body has a density of 1.90 g/cm$^3$ or higher and 2.40 g/cm$^3$ or lower and the dielectric waveguide end has a density that is 90% or less of the density of the dielectric waveguide body.

The first and second dielectric waveguides of the invention are each preferably formed from polytetrafluoroethylene.

The invention also relates to a connection structure including a hollow metallic tube and the aforementioned dielectric waveguide, the dielectric waveguide end being inserted in the hollow metallic tube and thereby the hollow metallic tube and the dielectric waveguide being connected to each other.

Preferably, the hollow metallic tube of the connection structure of the invention has a cavity filled with gas and the gas has a lower permittivity than the dielectric waveguide end.

The invention also relates to a method for producing a dielectric waveguide, including a step (2) of providing a resin line formed from polytetrafluoroethylene; a step (4) of heating an end of the resin line; and a step (5) of stretching the heated end in a longitudinal direction to provide a dielectric waveguide.

The heating in the step (4) is preferably performed at a temperature of 100° C. or higher and 450° C. or lower.

Advantageous Effects of the Invention

The first dielectric waveguide of the invention may be connected to a hollow metallic tube for use. The connection of the dielectric waveguide to the hollow metallic tube can be achieved by inserting the dielectric waveguide into the hollow metallic tube. Thus, the hollow metallic tube and the dielectric waveguide can be easily connected to each other. The dielectric waveguide includes a dielectric waveguide body and a dielectric waveguide end having a lower permittivity than the dielectric waveguide body. This can reduce a rapid change in impedance between the dielectric waveguide and the hollow metallic tube and enables a connection structure exhibiting low transmission and return losses. The dielectric waveguide body and the dielectric waveguide end are seamlessly and monolithically formed from the same material. This can eliminate the need for processing to form an interface and lead to excellent transmission efficiency. Accordingly, a change in impedance at an interface does not occur even when the dielectric waveguide is bent and a stress is applied. Thus, the dielectric waveguide can exhibit stable properties even when bent.

The second dielectric waveguide of the invention may be connected to a hollow metallic tube for use. The connection of the dielectric waveguide to the hollow metallic tube can be achieved by inserting the dielectric waveguide into the hollow metallic tube. Thus, the hollow metallic tube and the dielectric waveguide can be easily connected to each other. The dielectric waveguide includes a dielectric waveguide body and a dielectric waveguide end having a lower density than the dielectric waveguide body. This can reduce a rapid change in impedance between the dielectric waveguide and the hollow metallic tube and enables a connection structure exhibiting low transmission and return losses. The dielectric waveguide body and the dielectric waveguide end are seamlessly and monolithically formed from the same material. This can eliminate the need for processing to form an interface and lead to excellent transmission efficiency. Accordingly, a change in impedance at an interface does not occur even when the dielectric waveguide is bent and a stress is applied to the dielectric waveguide. Thus, the dielectric waveguide can exhibit stable properties even when bent.

The connection structure of the invention can provide a connection between a hollow metallic tube and a dielectric waveguide by insertion of the dielectric waveguide into the hollow metallic tube. Thus, the hollow metallic tube and the dielectric waveguide can be easily connected to each other. The dielectric waveguide includes a dielectric waveguide body and a dielectric waveguide end having a lower permittivity or density than the dielectric waveguide body. This can reduce a rapid change in impedance between the dielectric waveguide and the hollow metallic tube and enables low transmission and return losses. The dielectric waveguide body and the dielectric waveguide end are seamlessly and monolithically formed from the same material. This can eliminate the need for processing to form an interface and lead to excellent transmission efficiency.

The production method of the invention having the above features enable easy production of a dielectric waveguide that includes a dielectric waveguide end having a lower permittivity or density than a dielectric waveguide body, that is easily processed and connected even when having a small diameter, and that can provide a connection structure exhibiting low transmission and return losses of high frequency signals.

DETAILED DESCRIPTION OF PREFERRED EMBODIMENTS

Figure 1:
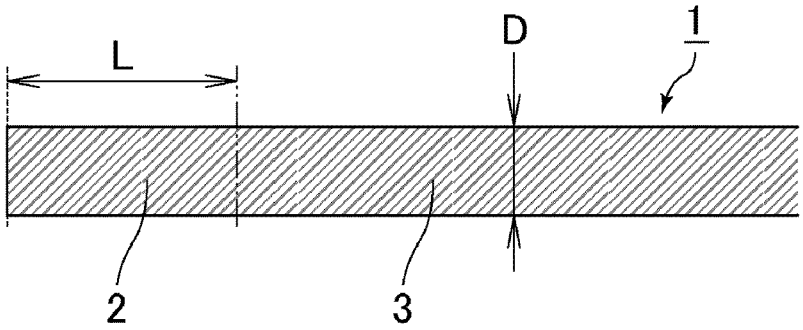
FIG. 1 is a cross-sectional view of an example of the dielectric waveguides of the invention.

FIG. 1 is a cross-sectional view of an example of the first and second dielectric waveguides of the invention. A dielectric waveguide 1 of FIG. 1 includes a dielectric waveguide body 3 and a dielectric waveguide end 2, and the dielectric waveguide end 2 has a lower permittivity or density than the dielectric waveguide body 3. The dielectric waveguide body 3 and the dielectric waveguide end 2 have different permittivities or densities, but they are not formed by bonding different materials. Thus, the dielectric waveguide 1 has no interface.

The dielectric waveguide body 3 is preferably a portion having the maximum density among the fragments obtained by cutting the dielectric waveguide at 10-mm intervals, for example, or a portion where the percent change in density from the maximum density is within 5%.

Letting the length of the dielectric waveguide end 2 be L (mm) and the diameter of the dielectric waveguide body 3 be D (mm), L and D preferably satisfy the following conditions:

when D is smaller than 0.5 mm, L/D=20;

when D is not smaller than 0.5 mm but smaller than 1 mm, L/D=10;

when D is not smaller than 1 mm but smaller than 10 mm, L/D=5 and the maximum L=10 mm; and when D is not smaller than 10 mm, L=10 mm.

In the dielectric waveguide of the invention, preferably, the dielectric waveguide body 3 has a permittivity of 1.80 or higher and 2.30 or lower and the dielectric waveguide end 2 has a permittivity of 2.20 or lower. In the dielectric waveguide of the invention, more preferably, the permittivity of the dielectric waveguide body 3 is 2.05 or higher and 2.30 or lower and the permittivity of the dielectric waveguide end 2 is 2.20 or lower.

The permittivity of the dielectric waveguide body 3 is preferably 1.80 or higher and 2.30 or lower. The permittivity is more preferably 1.90 or higher, still more preferably 2.05 or higher.

In order to achieve high transmission efficiency, the permittivity of the dielectric waveguide end 2 is preferably 2.20 or lower, more preferably 2.10 or lower, still more preferably 2.00 or lower.

In order to reduce a rapid change in permittivity, the permittivity of the dielectric waveguide end 2 may also preferably decrease gradually or stepwise toward the tip. For the dielectric waveguide end 2 having a permittivity that decreases toward the tip, the permittivity of the tip of the dielectric waveguide end 2 preferably falls within the above range. The reduction rate in permittivity of the dielectric waveguide end 2 in a direction toward the tip per 1 mm is preferably 0.005% or higher, more preferably 0.01% or higher, while preferably 20% or lower, more preferably 10% or lower.

The dielectric waveguide end 2 may also preferably have a lower density than the dielectric waveguide body 3. Such a difference in density can easily reduce a rapid change in permittivity, can reduce the return loss, and can lead to high transmission efficiency.

In the dielectric waveguide of the invention, preferably, the dielectric waveguide body 3 has a density of 1.90 g/cm$^3$ or higher and 2.40 g/cm$^3$ or lower and the dielectric waveguide end 2 has a density that is 90% or less of the density of the dielectric waveguide body 3.

The density of the dielectric waveguide body 3 is preferably 1.90 g/cm$^3$ or higher and 2.40 g/cm$^3$ or lower. The density is more preferably 1.95 g/cm$^3$ or higher. The density of the dielectric waveguide body 3 is more preferably 2.25 g/cm$^3$ or lower.

Common resin lines are known to have a lower permittivity as the density becomes lower. The density is a value determined by hydrostatic weighing in accordance with JIS Z8807.

In order to achieve high transmission efficiency, the density of the dielectric waveguide end 2 is preferably as low as possible, and is preferably 90% or less, more preferably 70% or less, still more preferably 40% or less of the density of the dielectric waveguide body 3. In order to achieve good strength of the dielectric waveguide end 2, the density thereof is preferably 10% or more, more preferably 30% or more of the density of the dielectric waveguide body 3.

In order to reduce a rapid change in permittivity, the density of the dielectric waveguide end 2 preferably decreases gradually or stepwise toward the tip. For the dielectric waveguide end 2 having a density that decreases toward the tip, the density of the tip of the dielectric waveguide end 2 preferably falls within the above range. The reduction rate in density of the dielectric waveguide end 2 in a direction toward the tip per 1 mm is preferably 0.05% or higher, more preferably 0.1% or higher, still more preferably 0.5% or higher. In order to achieve good strength of the dielectric waveguide end 2, the reduction rate in density of the dielectric waveguide end 2 in a direction toward the tip per 1 mm is preferably 30% or lower, more preferably 20% or lower, still more preferably 10% or lower.

The dielectric waveguide body 3 preferably has a hardness of 95 or higher. The hardness is more preferably 97 or higher, particularly preferably 98 or higher. The upper limit thereof may be, but is not limited to, 99.9. The dielectric waveguide body 3 having a hardness falling within the above range can have a high permittivity and can easily provide a dielectric waveguide having a low loss tangent. This dielectric waveguide is less likely to be damaged and is less likely to suffer blockage or breakage.

The hardness is determined by the spring hardness standardized in JIS K6253-3.

The hardness greatly contributes to the strength and bending stability of the dielectric waveguide. A higher hardness can lead to a higher strength and can further reduce a change in permittivity in bending and an increase in loss tangent.

The dielectric waveguide body 3 preferably has a loss tangent (tan δ) at 2.45 GHz of $1.20\times10^{-4}$ or lower. The loss tangent (tan δ) is more preferably $1.00\times10^{-4}$ or lower, still more preferably $0.95\times10^{-4}$ or lower. The lower limit of the loss tangent (tan δ) may be, but is not limited to, $0.10\times10^{-4}$ or $0.80\times10^{-4}$.

The loss tangent is determined at 2.45 GHz using a cavity resonator available from Kanto Electronic Application and Development Inc. The lower the loss tangent is, the better the transmission efficiency of the dielectric waveguide is.

The dielectric waveguide may have either a rectangular shape or a circular shape. Still, the dielectric waveguide more preferably has a circular shape because a circular dielectric waveguide can more easily be produced than rectangular one.

Figure 2:
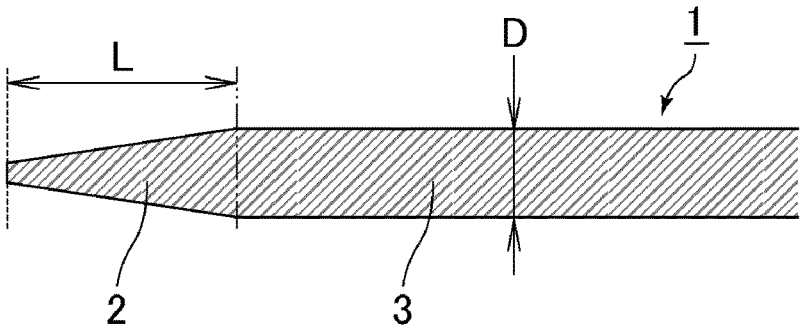
FIG. 2 is a cross-sectional view of an example of the dielectric waveguides of the invention.

FIG. 2 is also a cross-sectional view of an example of the first and second dielectric waveguides of the invention. The dielectric waveguide 1 of FIG. 2 includes the dielectric waveguide body 3 and the dielectric waveguide end 2 having a length L (mm). In this embodiment, the dielectric waveguide end 2 has a smaller cross-sectional area than the dielectric waveguide body 3 having a diameter D (mm). The dielectric waveguide end 2 having a smaller cross-sectional area than the dielectric waveguide body 3 can further reduce a rapid change in permittivity. The dielectric waveguide end 2 may have a shape of cone, truncated cone, pyramid, or truncated pyramid. A conical shape is easy to produce.

The cross-sectional area of the dielectric waveguide body 3 is preferably 0.008 $mm^2$ (ϕ0.1 mm: 1.8 THz) or larger and 18000 $mm^2$ (ϕ150 mm: 600 MHz) or smaller, more preferably 0.28 $mm^2$ (ϕ0.6 mm: 300 GHz) or larger and 64 $mm^2$ (ϕ9 mm: 20 GHz) or smaller, where ϕ signifies "diameter."

In order to achieve high transmission efficiency, the cross-sectional area of the dielectric waveguide end 2 is preferably 1% or more, more preferably 5% or more, still more preferably 10% or more of the cross-sectional area of the dielectric waveguide body 3. The cross-sectional area of the dielectric waveguide end 2 is also preferably 90% or less, more preferably 80% or less, still more preferably 70% or less of the cross-sectional area of the dielectric waveguide body 3.

In order to reduce a rapid change in permittivity, the cross-sectional area of the dielectric waveguide end 2 may also preferably decrease gradually or stepwise toward the tip. The reduction rate in cross-sectional area of the dielectric waveguide end 2 toward the tip per 1 mm is preferably 0.1% or higher, more preferably 0.5% or higher, still more preferably 1% or higher. The reduction rate in cross-sectional area of the dielectric waveguide end 2 toward the tip per 1 mm is also preferably 30% or lower, more preferably 20% or lower, still more preferably 10% or lower.

The dielectric waveguide 1 is preferably formed from polytetrafluoroethylene (PTFE). PTFE may be a homogenous PTFE consisting only of tetrafluoroethylene (TFE), or may be a modified PTFE consisting of TFE and a modifying monomer. The modifying monomer may be any monomer copolymerizable with TFE, and examples thereof include perfluoroolefins such as hexafluoropropylene (HFP); chlorofluoroolefins such as chlorotrifluoroethylene (CTFE); hydrogen-containing olefins such as trifluoroethylene and vinylidene fluoride (VDF); perfluoroalkyl ethylene; and ethylene. One modifying monomer may be used, or a plurality of modifying monomers may be used.

The modified PTFE preferably contains a unit of the modifying monomer in an amount of 3% by mass or less, more preferably 2% by mass or less, still more preferably 1% by mass or less of all monomer units. In order to improve the moldability and the transparency, this amount is preferably 0.001% by mass or more. The term "unit of the modifying monomer" herein means a moiety that is part of a molecular structure of the modified PTFE and is derived from the modifying monomer. The term "all monomer units" herein means the moieties derived from any of all monomers in the molecular structure of the modified PTFE.

The polytetrafluoroethylene may have a standard specific gravity (SSG) of 2.130 or higher and 2.250 or lower, preferably 2.150 or higher and 2.230 or lower. It may have non melt-processibility, and may have fibrillatability. The standard specific gravity is a value determined by the water replacement method in conformity with ASTM D-792 using a sample prepared in conformity with ASTM D-4895 10.5.

Figure 3:
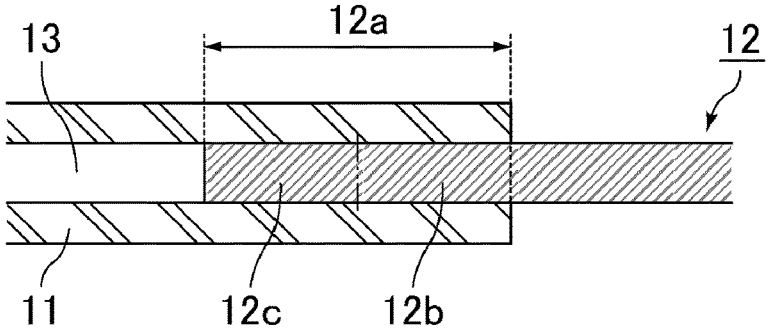
FIG. 3 is a cross-sectional view of an example of the connection structure of the invention.

In an aspect of the invention, a connection structure is provided. The connection structure includes a hollow metallic tube and the first or second dielectric waveguide of the invention, and the dielectric waveguide end is inserted in the hollow metallic tube and thereby the hollow metallic tube and the dielectric waveguide are connected to each other. FIG. 3 is a cross-sectional view of an example of the connection structure of the invention. The connection structure of FIG. 3 includes a hollow metallic tube 11 and a dielectric waveguide 12. The dielectric waveguide end 12*c* is inserted in the hollow metallic tube 11 and thus the dielectric waveguide end 12*c* is placed in the hollow metallic tube, whereby the hollow metallic tube 11 and the dielectric waveguide 12 are connected to each other. The dielectric waveguide 12 includes the dielectric waveguide body 12*b* and the dielectric waveguide end 12*c*, and the dielectric waveguide end 12*c* has a lower permittivity or density than the dielectric waveguide body 12*b*. The dielectric waveguide body 12*b* and the dielectric waveguide end 12*c* have different permittivities or densities, but they are not formed by bonding different materials. Thus, the dielectric waveguide 12 has no interface. The dielectric waveguide 12 is the same as the aforementioned dielectric waveguide 1.

Further, in FIG. 3, the cross section in the circumferential direction of the cavity of the hollow metallic tube 11 and the cross section in the circumferential direction of the dielectric waveguide 12 have the same shape and substantially the same size. Thus, the dielectric waveguide 12 is in close contact with the inner wall of the hollow metallic tube 11 and the dielectric waveguide 12 is fixed to the hollow metallic tube 11. Accordingly, the cavity of the hollow metallic tube 11 and the dielectric waveguide 12 having the same cross-sectional shape in the circumferential direction enable easy alignment of the center of the hollow metallic tube and the center of the dielectric waveguide. They also can prevent misalignment of the centers during use, and thus can much further reduce the return loss.

The dielectric waveguide 12 is not inserted to fill completely the cavity of the hollow metallic tube 11. Thus, the connection structure of FIG. 3 has a cavity 13. The cavity 13 is filled with gas and the gas may be the air.

The dielectric waveguide end 12*c* has a lower permittivity than the dielectric waveguide body 12*b*, and the gas inside the cavity 13 (the gas inside the hollow metallic tube 11) preferably has a lower permittivity than the dielectric waveguide end 12*c*. In other words, the dielectric waveguide end 12*c* having a permittivity lower than that of the dielectric waveguide body 12*b* and higher than that of the gas can reduce a rapid change in permittivity, reduce the return loss, and lead to high transmission efficiency.

The dielectric waveguide end 12*c* may also preferably have a lower density than the dielectric waveguide body 12*b*.

Common resin lines are known to have a lower permittivity as the density becomes lower. In the invention, the density of the dielectric waveguide end 12*c* is lower than the density of the dielectric waveguide body 12*b*, so that the dielectric waveguide end 12*c* has a reduced permittivity and the return loss at the interface between the cavity 13 and the gas is reduced. The density is a value determined by hydrostatic weighing in accordance with JIS Z8807.

The hollow metallic tube and the dielectric waveguide each may have either a rectangular shape or a circular shape. Still, for the above reasons, they preferably have the same shape. Each of them more preferably has a circular shape because a circular dielectric waveguide can more easily be produced than rectangular one.

In order to insert and fix the dielectric waveguide 12 in the hollow metallic tube 11, an inserted portion 12*a* of the dielectric waveguide 12 inserted in the hollow metallic tube 11 preferably has a certain degree of length. An inserted portion that is too long may not only fail to exert an effect that corresponds to the length but also result in a larger product. Thus, the length of the inserted portion 12*a* is preferably 1 mm or longer and 200 mm or shorter. Further, in order to reduce a rapid change in permittivity and to downsize the dielectric waveguide, the length of the dielectric waveguide end 12*c* is preferably 1 mm or longer and 50 mm or shorter.

Figure 4:
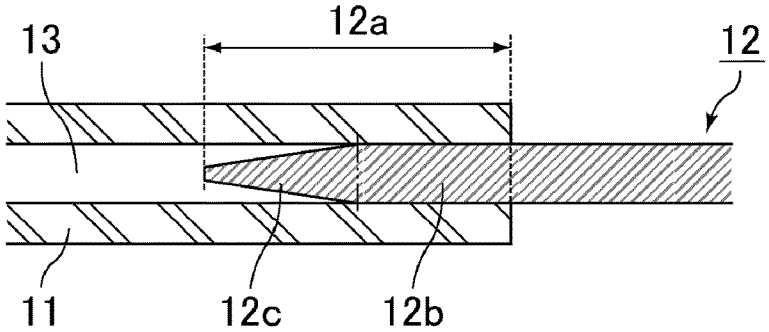
FIG. 4 is a cross-sectional view of an example of the connection structure of the invention.

FIG. 4 is also a cross-sectional view of an example of the connection structure of the invention. In an embodiment of FIG. 4, the connection structure includes the hollow metallic tube 11 having a cavity 13 and the dielectric waveguide 12 including inserted portion 12*a*. The dielectric waveguide end 12*c* is inserted in the hollow metallic tube 11 and thereby the hollow metallic tube 11 and the dielectric waveguide 12 are connected to each other. The dielectric waveguide 12 includes the dielectric waveguide body 12*b* and the dielectric waveguide end 12*c*, and the dielectric waveguide end 12*c* has a smaller cross-sectional area than the dielectric waveguide body 12*b*. The dielectric waveguide end 12*c* having a smaller cross-sectional area than the dielectric waveguide body 12*b* can further reduce a rapid change in permittivity, further reduce the return loss, and lead to much higher transmission efficiency. In comparison with the cases without a change in cross-sectional area, the dielectric waveguide end 12*c* can be shorter, resulting in downsizing. The dielectric waveguide end 12*c* may have a shape of cone, truncated cone, pyramid, or truncated pyramid. A conical shape is easy to produce.

The cross-sectional area of the dielectric waveguide body 12*b* is preferably 0.008 mm2 (ϕ0.1 mm: 1.8 THz) or larger and 18000 mm2 (ϕ150 mm: 600 MHz) or smaller, more preferably 0.28 mm2 (ϕ0.6 mm: 300 GHz) or larger and 64 mm2 (ϕ9 mm: 20 GHz) or smaller, where ϕ signifies "diameter."

As described above, the connection structure of the invention enables connection of a dielectric waveguide having a small diameter and a hollow metallic tube having a small diameter.

In order to easily fix the dielectric waveguide to the hollow metallic tube, the dielectric waveguide body 12*b* preferably has a length of 1 mm or longer and 199 mm or shorter. In order to achieve downsizing and to reduce a rapid change in permittivity, the dielectric waveguide end 12*c* preferably has a length of 1 mm or longer and 50 mm or shorter.

The hollow metallic tube 11 may be any metallic tube having a hollow portion or cavity 13, and may be a converter or a hollow waveguide. An embodiment in which a converter is used as a hollow metallic tube will be described in detail later.

Figure 5:
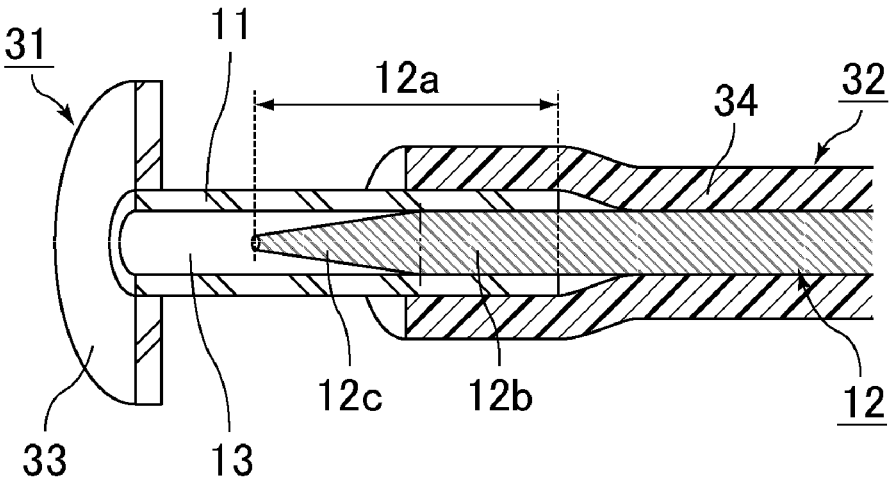
FIG. 5 is a cross-sectional view of an example of the connection structure of the invention.

FIG. 5 illustrates an embodiment in which a circular hollow metallic tube as illustrated in FIGS. 3 and 4 constitutes part of a converter. The hollow metallic tube 11 in FIG. 5 constitutes part of a converter 31, and the circular dielectric waveguide 12 including dielectric waveguide body 12*b* and dielectric waveguide end 12*c* is inserted therein. The dielectric waveguide 12 constitutes an inner layer of a dielectric waveguide 32 that includes an outer layer. The dielectric waveguide 12 is surrounded by an outer layer 34 having a lower permittivity than the dielectric waveguide 12. The dielectric waveguide 12 is inserted in the hollow metallic tube 11 having a cavity 13 so that the inserted portion 12*a* of the dielectric waveguide 12 is placed in the hollow metallic tube 11 and the hollow metallic tube 11 is inserted between the inserted portion 12*a* and the outer layer 34. Thereby, the dielectric waveguide 32 including the outer layer and the converter 31 are firmly connected to each other. The converter 31 includes a flange 33, and can be connected to a component such as a hollow waveguide (not illustrated) via the flange. The outer layer 34 may have an inner diameter of 0.1 mm or greater and 150 mm or smaller, preferably 0.6 mm or greater and 10 mm or smaller. The outer layer 34 may have an outer diameter of 0.5 mm or greater and 200 mm or smaller, preferably 1 mm or greater and 150 mm or smaller.

The following describes a method of forming the dielectric waveguide including the dielectric waveguide end having a lower permittivity or the dielectric waveguide including the dielectric waveguide end having a lower density from polytetrafluoroethylene (PTFE). These dielectric waveguides each may be obtainable by stretching an end of a resin line in the longitudinal direction.

The resin line may be obtainable by molding PTFE by a known molding method. Specifically, a PTFE line may be obtainable by mixing PTFE powder with an extrusion aid, molding the mixture into a pre-molded article using a pre-molding machine, and then paste extrusion molding the pre-molded article.

The paste extrusion molding may be performed without pre-molding. Specifically, a PTFE line may be obtainable by mixing PTFE powder with an extrusion aid, directly putting the mixture into a cylinder of a paste extruder, and then paste extrusion molding the mixture.

Then, an end of the resulting resin line is stretched in the longitudinal direction. This can provide a dielectric waveguide whose end has a lower permittivity than the other portions or a dielectric waveguide whose end has a lower density than the other portions. In this process, heating only a portion to be stretched facilitates production of a desired dielectric waveguide end. The stretch ratio may be 1.2 times or higher and 5 times or lower.

The method of stretching an end of a resin line in the longitudinal direction can provide the aforementioned dielectric waveguides whose dielectric waveguide end has a smaller cross-sectional area than the dielectric waveguide body.

The stretching may be performed by holding an end of a resin line with a tool such as pliers and stretching the resin line in the longitudinal direction. If the held portion is not stretched, this portion may be cut off. This can easily provide a truncated-cone-shaped dielectric waveguide end having a permittivity or a density that gradually or stepwise decreases toward the tip and having a cross-sectional area that gradually or stepwise decreases toward the tip.

In an aspect of the invention, a method for producing a dielectric waveguide is provided. This method includes a step (2) of providing a resin line formed from polytetrafluoroethylene, a step (4) of heating an end of the resin line, and a step (5) of stretching the heated end in the longitudinal direction to provide a dielectric waveguide.

The respective steps are described hereinbelow.

The production method of the invention preferably includes a step (1) of mixing polytetrafluoroethylene (PTFE) powder with an extrusion aid to provide a pre-molded article of PTFE before the step (2).

The PTFE powder is produced from a homogenous PTFE consisting only of tetrafluoroethylene (TFE), a modified PTFE consisting of TFE and a modifying monomer, or a mixture thereof. The modifying monomer may be any monomer copolymerizable with TFE, and examples thereof include perfluoroolefins such as hexafluoropropylene (HFP); chlorofluoroolefins such as chlorotrifluoroethylene (CTFE); hydrogen-containing olefins such as trifluoroethylene and vinylidene fluoride (VDF); perfluoroalkyl ethylene; and ethylene. One modifying monomer may be used, or a plurality of modifying monomers may be used.

The modified PTFE preferably contains a unit of the modifying monomer in an amount of 3% by mass or less, more preferably 2% by mass or less, still more preferably 1% by mass or less of all monomer units. In order to improve the moldability and the transparency, this amount is preferably 0.001% by mass or more.

The PTFE may have a standard specific gravity (SSG) of 2.130 or higher and 2.250 or lower, preferably 2.150 or higher and 2.230 or lower. It may have non melt-processibility, and may have fibrillatability. The standard specific gravity is a value determined by the water replacement method in conformity with ASTM D-792 using a sample prepared in conformity with ASTM D-4895 10.5.

The PTFE powder mixed with an extrusion aid may be aged at room temperature for about 12 hours to provide extrusion aid-mixed powder. This powder may be put into a pre-molding machine and pre-molded at 1 MPa or higher and 10 MPa or lower, more preferably 1 MPa or higher and 5 MPa or lower, for 1 minute or longer and 120 minutes or shorter. This can provide a pre-molded article of PTFE.

The extrusion aid may be hydrocarbon oil, for example.

The amount of the extrusion aid is preferably 10 parts by mass or more and 40 parts by mass or less, more preferably 15 parts by mass or more and 30 parts by mass or less, relative to 100 parts by mass of the PTFE powder.

Step (2)

This step is a step of providing a resin line formed from PTFE.

In the case where the step (1) is performed to provide a pre-molded article of PTFE, this pre-molded article may be extruded using a paste extruder to provide a resin line in the step (2).

In the case where no pre-molded article of PTFE is prepared before the step (2), PTFE powder may be mixed with an extrusion aid, the mixture may directly be put into a cylinder of a paste extruder, and the mixture may be paste extrusion molded to provide a resin line.

For the resin line containing an extrusion aid, the resin line is preferably heated at 80° C. or higher and 250° C. or lower for 0.1 hours or longer and 6 hours or shorter to evaporate the extrusion aid.

The resin line may have either a rectangular shape or a circular shape. Still, it preferably has a circular shape because a circular resin line can more easily be produced than rectangular one. The resin line may have a diameter of 0.1 mm or greater and 150 mm or smaller, preferably 0.6 mm or greater and 9 mm or smaller.

The production method of the invention may include a step (3) of heating the resin line obtained in the step (2).

Specific heating conditions are changed as appropriate in accordance with the shape and size of the resin line. For example, the resin line is preferably heated at 326° C. to 345° C. for 10 seconds to 2 hours. The heating temperature is more preferably 330° C. or higher and 380° C. or lower. The heating duration is more preferably one hour or longer and three hours or shorter.

Heating at the above temperature for a predetermined duration causes the air contained in the resin line to be released to the outside. This seems to enable a dielectric waveguide having a high permittivity. Further, the resin line is not completely baked. This seems to enable a dielectric waveguide having a low loss tangent. Further, heating at the above temperature for a predetermined duration can advantageously improve the hardness of the resin line and increase the strength thereof.

The heating may be performed using a salt bath, a sand bath, a hot air circulating electric furnace, or the like. In order to easily control the heating conditions, the heating is preferably performed using a salt bath. This can also advantageously shorten the heating time within the above range. The heating with a salt bath may be performed using a device for producing a coated cable disclosed in JP 2002-157930 A, for example.

Step (4)

This is a step of heating an end of the resin line obtained in the step (2). This step may be a step of heating an end of the resin line obtained in the step (3).

In the step (4), an end of the resin line is heated, so that a desired dielectric waveguide end can easily be produced.

In the step (4), although not limited, a portion to be heated is preferably apart from a tip of the resin line by 0.8 mm or more and 150 mm or less, more preferably a portion to be heated is apart therefrom by 20 mm or less.

The heating temperature in the step (4) is preferably 100° C. or higher, more preferably 200° C. or higher, still more preferably 250° C. or higher. The heating temperature in the step (4) is preferably 450° C. or lower, more preferably 400° C. or lower, still more preferably 380° C. or lower.

Step (5)

This step is a step of stretching the heated end obtained in the step (4) in the longitudinal direction to provide a dielectric waveguide.

The stretching may be performed by holding the heated end obtained in the step (4) with a tool such as pliers and stretching the resin line in the longitudinal direction. If the held portion is not stretched, this portion may be cut off. This can easily provide a truncated-cone-shaped dielectric waveguide end having a permittivity or a density that gradually or stepwise decreases toward the tip and having a cross-sectional area that gradually or stepwise decreases toward the tip.

The stretch ratio is preferably 1.2 times or more, more preferably 1.5 times or more. The stretch ratio is preferably 10 times or less, more preferably 5 times or less.

The stretching speed is preferably 1%/sec or higher, more preferably 10%/sec or higher, still more preferably 20%/sec or higher. The stretching speed is preferably 1000%/sec or lower, more preferably 800%/sec or lower, still more preferably 500%/sec or lower.

The production method of the invention may include a step (6) of inserting the dielectric waveguide obtained in the step (5) into an outer layer.

The outer layer may be formed from the same PTFE as for the dielectric waveguide.

The outer layer may be formed from a hydrocarbon resin such as polyethylene, polypropylene, or polystyrene, and may be formed from the resin in a foamed state.

The outer layer formed from PTFE may be produced by the following method, for example.

PTFE powder is mixed with an extrusion aid and is aged at room temperature for 1 hour or longer and 24 hours or shorter. The resulting extrusion aid-mixed powder is put into a pre-molding machine and pressurized at 1 MPa or higher and 10 MPa or lower for about 30 minutes. Thereby, a cylindrical pre-molded article of PTFE may be obtained. The pre-molded article of PTFE is extrusion molded using a paste extruder. Thereby, a hollow cylindrical molded article is obtained. When this molded article contains an extrusion aid, this molded article is preferably heated at 80° C. or higher and 250° C. or lower for 0.1 hours or longer and 6 hours or shorter so that the extrusion aid is evaporated. This molded article is stretched at 250° C. or higher and 320° C. or lower, more preferably 280° C. or higher and 300° C. or lower and at 1.2 times or more and 5 times or less, more preferably 1.5 times or more and 3 times or less. Thereby, a hollow cylindrical outer layer may be obtained.

The outer layer may have an inner diameter of 0.1 mm or greater and 150 mm or smaller, preferably 0.6 mm or greater and 10 mm or smaller. The outer layer may have an outer diameter of 0.5 mm or greater and 200 mm or smaller, preferably 1 mm or greater and 150 mm or smaller.

The connection structure of the invention may favorably be produced by a method including a step of connecting a hollow metallic tube and the dielectric waveguide obtained in the step (5) to provide a connection structure. The connection structure of the invention may favorably be produced by a method including a step of connecting a hollow metallic tube and the dielectric waveguide inserted in the outer layer obtained in the step (6) to provide a connection structure.

In these steps, for example, the dielectric waveguide obtained in the step (5) or the dielectric waveguide inserted in the outer layer obtained in the step (6) is inserted into a hollow metallic tube. Thereby, a connection structure may be obtained.

The hollow metallic tube may have either a rectangular shape or a circular shape. Still, in order to easily align the center of the hollow metallic tube and the center of the dielectric waveguide and to prevent misalignment of the centers during use, to thereby much further reduce the return loss, the shape of the hollow metallic tube is preferably the same as the cross-sectional shape in the circumferential direction of the dielectric waveguide. Further, the hollow metallic tube preferably has a circular shape because a circular dielectric waveguide can more easily be produced than rectangular one.

The hollow metallic tube may be formed from any material, such as copper, brass, aluminum, stainless steel, silver, or iron. One of the metals may be used alone, or a plurality thereof may be used in combination.

The hollow metallic tube may be any metallic tube having a cavity, and may be a converter or a hollow waveguide.

Even for a dielectric waveguide formed from a resin such as polyethylene resin, polypropylene resin, or polystyrene resin, stretching of an end of a resin line in the longitudinal direction can easily provide a dielectric waveguide whose dielectric waveguide end has a smaller cross-sectional area than the dielectric waveguide body.

EXAMPLES

The invention is described with reference to examples. These examples are not intended to limit the invention.

Experimental Example

PTFE fine powder (SSG: 2.175) in an amount of 100 parts by mass was mixed with 20.5 parts by mass of ISOPAR G® (isoparaffinic hydrocarbon) available from Exxon Mobil Corp. serving as an extrusion aid, and the mixture was aged at room temperature for 12 hours. Thereby, an extrusion aid-mixed powder was obtained. This extrusion aid-mixed powder was put into a pre-molding machine and pressurized at 3 MPa for 30 minutes. Thereby, a cylindrical pre-molded article was obtained.

This pre-molded article was paste-extruded using a paste extruder, and then heated at 200° C. for one hour so that the extrusion aid was evaporated. Thereby, a resin line having a diameter of 3.51 mm was obtained.

This resin line was cut so as to have a total length of 660 mm.

Outer Layer:

PTFE fine powder was mixed with Isopar G available from Exxon Mobil Corp. serving as an extrusion aid, and the mixture was aged at room temperature for 12 hours. Thereby, an extrusion aid-mixed powder was obtained. This extrusion aid-mixed powder was put into a pre-molding machine and pressurized at 3 MPa for 30 minutes. Thereby, a cylindrical pre-molded article was obtained.

This pre-molded article was paste-extruded using a paste extruder, and then heated at 200° C. for one hour so that the extrusion aid was evaporated. Thereby, a molded article having an outer diameter of 10 mm and an inner diameter of 3.6 mm was obtained. This molded article was stretched at a ratio of two times at 300° C. Thereby, an outer layer having an outer diameter of 9.5 mm and an inner diameter of 3.6 mm was obtained.

The resin line was inserted into the outer layer. Thereby, a dielectric waveguide including an outer layer was obtained.

Example 1

The resin line obtained in the experimental example was heated at 330° C. for 70 minutes. A portion (end) 20 mm or less apart from a tip of the resin line was heated at 260° C. A portion 5 mm or less apart from the tip was then held and the end was stretched at a stretch ratio of two times and at a stretching speed of 200%/sec in the longitudinal direction. Thereby, the end was stretched to 40 mm. After the stretching, a portion 10 mm or less apart from the tip held in the stretching was cut off. Thereby, a dielectric waveguide was obtained.

This dielectric waveguide was inserted into the outer layer obtained in the experimental example. Thereby, a dielectric waveguide including an outer layer was obtained.

Example 2

Without heating the resin line obtained in the experimental example, a portion (end) 20 mm or less apart from a tip of the resin line was heated up to 230° C. A portion 5 mm or less apart from the tip was then held and the end was stretched at a stretch ratio of two times and at a stretching speed of 200%/sec in the longitudinal direction. Thereby, the end was stretched to 40 mm. After the stretching, a portion 10 mm or less apart from the tip held in the stretching was cut off. Thereby, a dielectric waveguide was obtained.

This dielectric waveguide was inserted into the outer layer obtained in the experimental example. Thereby, a dielectric waveguide including an outer layer was obtained.

Comparative Example 1

The resin line obtained in the experimental example was heated at 330° C. for 70 minutes. Thereby, a dielectric waveguide was obtained.

This dielectric waveguide was inserted into the outer layer obtained in the experimental example. Thereby, a dielectric waveguide including an outer layer was obtained.

The physical properties of the resulting dielectric waveguides are shown in Table 1.

TABLE 1

| | | A | B | C | D |
|---|---|---|---|---|---|
| Example 1 | Diameter (mm) | 2.21 | 2.43 | 3.03 | 3.12 |
| | Cross-sectional area ($mm^2$) | 3.84 | 4.64 | 7.21 | 7.65 |
| | Density ($g/cm^3$) | 1.40 | 1.52 | 2.16 | 2.23 |
| | Permittivity | 1.76 | 1.82 | 2.16 | 2.20 |
| Example 2 | Diameter (mm) | 3.28 | 3.37 | 3.51 | 3.51 |
| | Cross-sectional area ($mm^2$) | 8.45 | 8.92 | 9.68 | 9.68 |
| | Density ($g/cm^3$) | 1.20 | 1.53 | 1.77 | 1.77 |
| | Permittivity | 1.65 | 1.83 | 1.95 | 1.95 |
| Comparative Example 1 | Diameter (mm) | 3.12 | 3.12 | 3.12 | 3.12 |
| | Cross-sectional area ($mm^2$) | 7.65 | 7.65 | 7.65 | 7.65 |
| | Density ($g/cm^3$) | 2.23 | 2.23 | 2.23 | 2.23 |
| | Permittivity | 2.20 | 2.20 | 2.20 | 2.20 |

Figure 6:
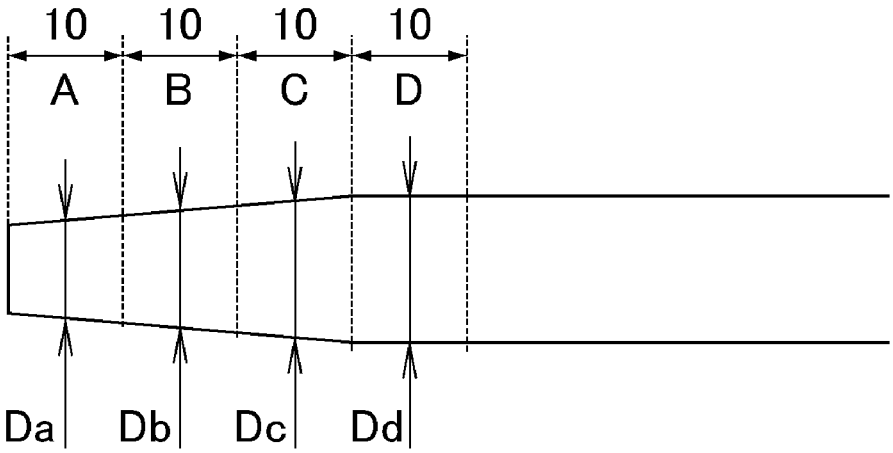
FIG. 6 is a cross-sectional view of a dielectric waveguide produced in an example.

The physical properties shown in Table 1 were determined by the following methods. A to D shown in Table 1 are illustrated in FIG. 6. In FIG. 6, the figures "10" indicate that the length of each of A to D is 10 mm.

Diameter and Cross-Sectional Area

Each of the resulting dielectric waveguides was cut at 10-mm intervals from a tip and the diameter Da, Db, Dc and Dd of the midpoint of each fragment, respectively, was measured using vernier caliper. Thereby, the cross-sectional area was calculated.

Density

The density was determined by hydrostatic weighing in accordance with JIS Z8807.

Permittivity

From the viewpoint of the structure of the dielectric waveguide, the permittivity is difficult to measure directly. Thus, the permittivity of each of the dielectric waveguides obtained in Examples 1 and 2 and Comparative Example 1 was calculated by the following method. Resin lines each having a diameter of 2 mm were produced in the same manner as in the experimental example, except that the diameter of each resin line was 2 mm. The extrusion aid was then evaporated, and the resin lines were heated at 330° C. for 70 minutes and stretched at a ratio of 1 time or 1.5 times. Thereby, samples having a density of 2.23 $g/cm^3$ or 1.80 $g/cm^3$ were produced. Also, resin lines each having a diameter of 2 mm were produced in the same manner as in the experimental example, except that the diameter of each resin line was 2 mm. The extrusion aid was then evaporated, and the resin lines were stretched at a ratio of 1 time, 1.5 times, or 2 times in the longitudinal direction without heat treatment. Thereby, samples having a density of 1.60 $g/cm^3$, 1.38 $g/cm^3$, or 0.71 $g/cm^3$ were produced. For the resulting samples, the permittivity was measured as follows and the correlation between the density and the permittivity was examined as shown in Table 2. The permittivity at a density of 0.00 $g/cm^3$ corresponds to the permittivity of the air. The density was determined by hydrostatic weighing in accordance with JIS Z8807. The permittivity was determined using a cavity resonator available from Kanto Electronic Application and Development Inc. (perturbation, 2.45 GHz) and Network Analyzer HP8510C available from HP Inc. Based on the above values, the relation between the permittivity and the density was examined to find the following correlation between the density (X) and the permittivity (Y). With the following formula, the permittivity was calculated from the density of the dielectric waveguide.

$$Y=0.533X+1.01$$

TABLE 2

| Density X | Permittivity Y |
|---|---|
| $g/cm^3$ | — |
| 0.00 | 1.00 |
| 0.71 | 1.40 |
| 1.38 | 1.75 |
| 1.60 | 1.85 |
| 1.80 | 1.96 |
| 2.23 | 2.20 |

The physical properties shown in Table 3 were determined by the following methods.

Hardness

The hardness was measured using a spring type durometer (JIS type A) standardized in JIS K6253-3.

Loss Tangent (tan δ)

The loss tangent was determined using a cavity resonator (2.45 GHz) available from Kanto Electronic Application and Development Inc.

Bending Stability

Figure 7A:
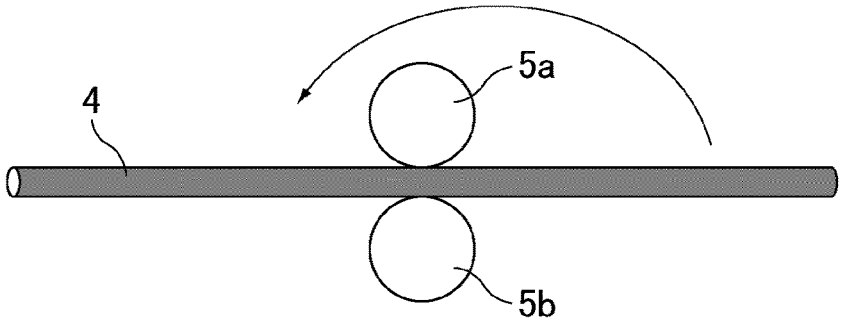
FIGS. 7A to 7E are diagrams illustrating a method of bending a dielectric waveguide in a testing methodology for evaluating the bending stability of a dielectric waveguide body.
Figure 7B:
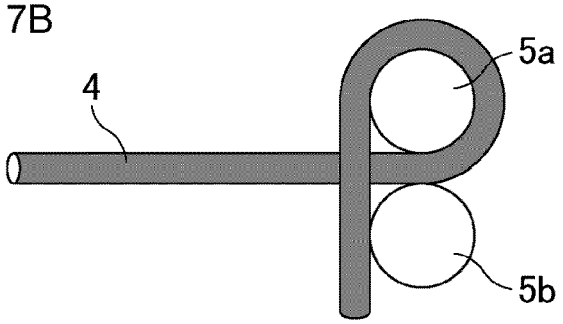
Figure 7C:
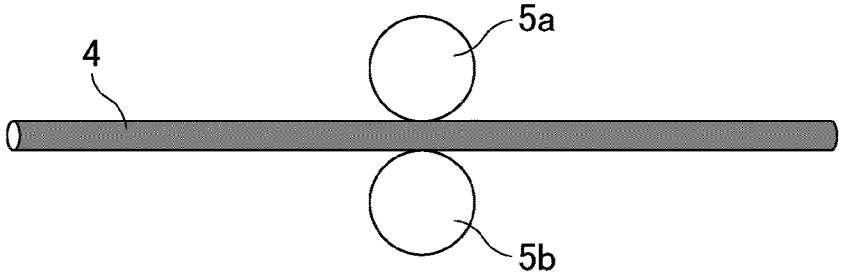
Figure 7D:
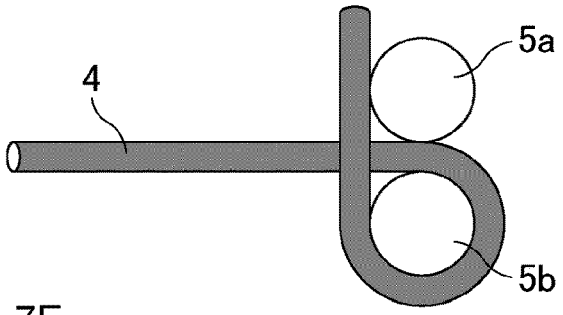
Figure 7E:
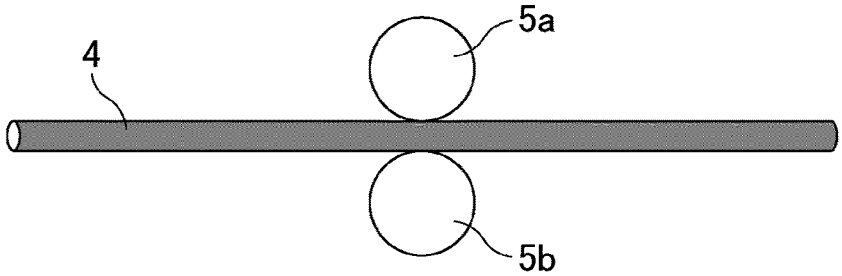

The dielectric waveguide body was cut to have a length of 60 mm. Thereby, a sample was produced. First, the density of the resulting sample was measured and the permittivity (A) was calculated from the density value. Then, as shown in FIGS. 7A to 7E, a sample 4 thus obtained was placed between and around bars 5*a* and 5*b* each having a diameter of 10 mm (FIG. 7A). The sample 4 was wound round the bar 5*a* and bent 270° (FIG. 7B), and then the sample 4 was returned to a straight state (FIG. 7C). Next, the sample 4 was wound around the round bar 5*b* and bent 270° (FIG. 7D), and then the sample 4 was returned to a straight state (FIG. 7E). This series of operations is taken as 1 process, and this process was repeated 10 times. After the above operations, the density of the sample 4 was measured and the permittivity (B) was calculated. For the bending stability, the permittivity change ratio (B/A) of the dielectric waveguide body before and after the bending was calculated. The conversion from the density (X) to the permittivity (Y) was performed using the following formula.

$$Y=0.533X+1.01$$

Difference in Permittivity between Dielectric Waveguide and Outer Layer

For the permittivity of the dielectric waveguide and the permittivity of the outer layer, the densities of the dielectric waveguide and the outer layer were measured and then converted by the following formula.

The density (X) and the permittivity (Y) show the following correlation.

$$Y=0.533X+1.01$$

The difference in permittivity between the dielectric waveguide and the outer layer is defined as the value obtained by subtracting the permittivity of the outer layer from the permittivity of the dielectric waveguide. (Difference in permittivity between dielectric waveguide and outer layer)=(permittivity of dielectric waveguide)−(permittivity of outer layer)

Return Loss at Dielectric Waveguide End

As shown in FIG. 5, a first end 12*c* and a second end (not illustrated) of the dielectric waveguide inserted in the outer layer 34 was inserted into the hollow metallic tube 11 of each of a first converter 31 and a second converter (not illustrated), respectively. The flange 33 of each of the first converter 31 and the second converter (not illustrated) was coupled with the circular waveguide side of a corresponding one of first and second circular waveguide-rectangular waveguide converters (not illustrated). The rectangular waveguide sides of the first and second circular waveguide-rectangular waveguide converters were respectively coupled with the first and second rectangular waveguides. These first and second rectangular waveguides were respectively connected to a first terminal (not illustrated) and a second terminal (not illustrated) of the network analyzer, and the parameter S11 was measured. The maximum reflection value between 60 GHz and 65 GHz was taken as the return loss. The zero-point adjustment was performed as follows. First, the circular waveguide sides of the first and second circular waveguide-rectangular waveguide converters were connected to each other in the absence of a dielectric waveguide in between. Next, the rectangular waveguide sides of the first and second circular waveguide-rectangular waveguide converters were respectively coupled with the first and second rectangular waveguides. Then, the first and second rectangular waveguides were respectively connected to the first terminal and the second terminal of the network analyzer.

TABLE 3

| | Loss tangent (tanσ) ($\times 10^{-4}$) | Hardness Shore A | Bending stability (permittivity change ratio of dielectric waveguide body before and after bending) | Difference in permittivity between dielectric waveguide and outer layer | Return loss at dielectric waveguide end unit: dB |
|---|---|---|---|---|---|
| Example 1 | 1.00 | 98 | 0.998 | 0.8 | −15 |
| Example 2 | 0.30 | 68 | 0.682 | 0.3 | −11 |
| Comparative Example 1 | 0.30 | 98 | 0.99 | 0.8 | −8 |

Examples 3 and 4 and Comparative Example 2

As shown in FIG. 5, the dielectric waveguide inserted in the outer layer obtained in each of Examples 1 and 2 and Comparative Example 1 was inserted into the hollow metallic tube of the converter, so that the dielectric waveguide inserted in the outer layer and the hollow metallic tube of the converter were connected to each other. Then, the transmission loss and the return loss were determined. The results are shown in Table 4.

TABLE 4

| | Dielectric waveguide | Frequency | (GHz) | 60 | 75 | 100 | 150 | 200 | 250 | 300 |
|---|---|---|---|---|---|---|---|---|---|---|
| Example 3 | Dielectric waveguide inserted in outer layer obtained in Example 1 | Transmission loss | (dB/cm) | −0.09 | −0.09 | −0.09 | −0.09 | −0.09 | −0.09 | −0.09 |
| | | Return loss | (dB) | | | | −15 | | | |
| Example 4 | Dielectric waveguide inserted in outer layer obtained in Example 2 | Transmission loss | (dB/cm) | −0.09 | −0.09 | −0.09 | −0.09 | −0.09 | −0.09 | −0.09 |
| | | Return loss | (dB) | | | | −15 | | | |
| Comparative Example 2 | Dielectric waveguide inserted in outer layer obtained in Comparative Example 1 | Transmission loss | (dB/cm) | −0.15 | −0.15 | −0.15 | −0.15 | −0.15 | −0.15 | −0.15 |
| | | Return loss | (dB) | | | | −8 | | | |

The physical properties shown in Table 4 were determined by the following methods.

Transmission Loss and Return Loss

As shown in FIG. 5, each end of the dielectric waveguide inserted in the outer layer was inserted into the hollow metallic tube 11 of each of two converters 31. The flange 33 of each converter 31 was coupled with the circular waveguide side of a corresponding one of circular waveguide-rectangular waveguide converters 1 and 2. The rectangular waveguide sides of the circular waveguide-rectangular waveguide converters 1 and 2 were respectively coupled with the rectangular waveguides 1 and 2. These rectangular waveguides 1 and 2 were respectively connected to a first terminal and a second terminal of the network analyzer. Then, the parameter S21 and the parameter S11 were measured, which were respectively taken as the transmission loss and the return loss. The zero-point adjustment was performed as follows. First, the circular waveguide sides of the circular waveguide-rectangular waveguide converters 1 and 2 were connected to each other in the absence of a dielectric waveguide in between. Next, the rectangular waveguide sides of the circular waveguide-rectangular waveguide converters 1 and 2 were respectively coupled with the rectangular waveguides 1 and 2. Then, the rectangular waveguides 1 and 2 were respectively connected to the first terminal and the second terminal of the network analyzer.

REFERENCE SIGNS LIST

1: dielectric waveguide
2: dielectric waveguide end
3: dielectric waveguide body
11: hollow metallic tube
12: dielectric waveguide
12*a*: inserted portion of dielectric waveguide
12*b*: dielectric waveguide body
12*c*: dielectric waveguide end
13: cavity in hollow metallic tube
31: converter
32: dielectric waveguide including outer layer
33: flange
34: outer layer
4: dielectric waveguide body
5*a*, 5*b*: round bar

The invention claimed is:

1. A method for producing a dielectric waveguide, comprising:

a step of providing a resin line formed from polytetrafluoroethylene;

a step of heating the resin line at 326° C. to 345° C. for 10 seconds to 2 hours;

a step of heating an end of the resin line; and a step of stretching the heated end in a longitudinal direction to provide a dielectric waveguide.

2. The production method according to claim 1, wherein the step of heating is performed at a temperature of 100° C. or higher and 450° C. or lower.

3. A dielectric waveguide comprising:

a dielectric waveguide body; and a dielectric waveguide end having a lower permittivity than the dielectric waveguide body, the dielectric waveguide body and the dielectric waveguide end being seamlessly and monolithically formed from a same material, wherein the dielectric waveguide body has a density of 1.90 g/cm$^3$ or higher and 2.40 g/cm$^3$ or lower, and the dielectric waveguide end has a density that is 90% or less of the density of the dielectric waveguide body.

4. The dielectric waveguide according to claim 3, wherein the dielectric waveguide body has a permittivity of 2.05 or higher and 2.30 or lower, and the dielectric waveguide end has a permittivity that is (i) lower than the permittivity of the dielectric waveguide body and that is (ii) 2.20 or lower, where both (i) and (ii) are satisfied.

5. The dielectric waveguide according to claim 3, wherein the dielectric waveguide body has a hardness of 95 or higher which is a spring hardness determined pursuant to JIS K6253-3.

6. The dielectric waveguide according to claim 3, wherein the dielectric waveguide body has a loss tangent at 2.45 GHz of $1.20\times10^{-4}$ or lower.

7. The dielectric waveguide according to claim 3, wherein the dielectric waveguide is obtainable by stretching an end of a resin line in a longitudinal direction.

8. The dielectric waveguide according to claim 3, wherein the dielectric waveguide is formed from polytetrafluoroethylene.

9. A connection structure comprising:

a hollow metallic tube; and the dielectric waveguide according to claim 3, the dielectric waveguide end being inserted in the hollow metallic tube and thereby the hollow metallic tube and the dielectric waveguide being connected to each other.

10. The connection structure according to claim 9, wherein the hollow metallic tube has a cavity filled with gas, and the gas has a lower permittivity than the dielectric waveguide end.

11. A dielectric waveguide comprising:

a dielectric waveguide body; and a dielectric waveguide end having a lower density than the dielectric waveguide body, the dielectric waveguide body and the dielectric waveguide end being seamlessly and monolithically formed from a same material, wherein the dielectric waveguide body has a density of 1.90 g/cm$^3$ or higher and 2.40 g/cm$^3$ or lower, and the dielectric waveguide end has a density that is 90% or less of the density of the dielectric waveguide body.

* * * * *